United States Patent [19]

Atkinson et al.

[11] 4,388,951

[45] Jun. 21, 1983

[54] WEAVING LOOMS HAVING ROTARY SHED FORMING DRUMS AND BEAT UP MECHANISMS THEREFOR

[75] Inventors: Cyril M. Atkinson, Rothley; Barry C. Strong, Syston, both of England

[73] Assignee: Bentley Weaving Machinery Limited, Loughborough, Leicestershire, England

[21] Appl. No.: 187,622

[22] Filed: Sep. 15, 1980

[30] Foreign Application Priority Data

Sep. 27, 1979 [GB] United Kingdom ..... 7933566

[51] Int. Cl.[3] ..... D03D 47/00

[52] U.S. Cl. ..... 139/11; 139/28; 139/191

[58] Field of Search ..... 139/11 R, 11 A, 28, 139/429, 436, 188 R, 190, 191

[56] References Cited

U.S. PATENT DOCUMENTS 2,845,093 7/1958 Dietzsch et al. ..... 139/436
2,900,837 8/1959 Brandt ..... 139/333
4,122,871 10/1978 McGinley ..... 139/429
4,129,153 12/1978 Bonetti ..... 139/28

FOREIGN PATENT DOCUMENTS 2151579 4/1973 Fed. Rep. of Germany ..... 139/190

*Primary Examiner*—Henry Jaudon

[57] ABSTRACT

The invention relates to a weaving loom having a rotary shed forming drum, means for guiding warps around the drum to a fabric take-up mechanism, means for inserting wefts into successive sheds as the drum rotates from a warp take-on position to a fabric take-up position, weft control elements on the drum extending outwards of the drum between warps to locate inserted wefts, and a beat up mechanism including a beat up bar mounting rotatable in synchronism with the shed forming drum, a plurality of beat up bars pivotably mounted on the mounting and having beat up elements extending outwards of the beat up bars, and cam means for controlling the beat up elements to cause them to locate the wefts as the warps pass to the fabric take-up position radially outwards of the shed forming drum and to beat up the wefts and for permitting pivotting of the beat up elements contrary to the direction of rotary movement of the beat up bar mounting so as to move the beat up elements clear of the fabric after beating up.

12 Claims, 6 Drawing Figures

WEAVING LOOMS HAVING ROTARY SHED FORMING DRUMS AND BEAT UP MECHANISMS THEREFOR

DESCRIPTION

1. Field of Invention

The invention relates to weaving looms having rotary shed forming drums especially of the kind described in the U.S. Pat. No. 4,129,153 and in particular to beat up mechanisms for the weaving looms.

2. Background of Invention

Weaving looms as described in the above-mentioned U.S. Patent have potentially a very high frequency of pick insertion and consequently require the same high frequency in beating up. The sheds close as the warps are taken-off the machine by a gradual and not an abrupt motion. Successive wefts inserted on a shed forming drum are spaced apart by a considerable distance equivalent to the distance between successive rapiers and the wefts are advanced through the sheds at a beat up zone up to the position known in the weaving art as the "fell" where the newly inserted wefts are beaten against the fabric proper. The warps are advanced more slowly than the sheds and the wefts. The beat up mechanism described in the French Patent Specification No. 77 03110 uses a beat up roller with a single fixed inclined comb for engaging the weft.

The West-German Offenlegungsschrift No. 2,151,579 describes a beat up mechanism with individually pivotable reeds on a rotatable mounting. Mountings carrying two or three reeds and influencing the reeds through springs and weights are illustrated. The mechanism is unsuitable for high pick insertion frequencies. The reeds are withdrawn tangentially with respect to the mounting and so urge the weft downward for a considerable period. The reeds are projected by centrifugal forces and cannot engage a weft to advance it against friction to the fell. No means is described for controlling the weft to permit it to be picked up reliably for advancing to the fell. In close weaves misalignment of individual reeds could cause them to pivot prematurely on the mounting and not to participate in beating up the weft. The fell position is determined by a reed abutment. The reeds require an unobstructed area for their operation.

It is the object of the invention to provide a weaving loom having a beat up mechanism which can operate at high frequencies and/or produce a regular woven fabric structure and/or produce a tight weave.

It is a subsidiary object of the invention to produce a beat up mechanism which can be adjusted to cooperate optimally with a rotary weaving loom.

SUMMARY OF INVENTION

According to this invention there is provided a weaving loom having a rotary shed forming drum, means for guiding warps around the drum to a fabric take-up mechanism, means for inserting wefts into successive sheds as the drum rotates from a warp take-on position to a fabric take-up position, weft control elements on the drum extending outwards of the drum between warps to locate inserted wefts, and a beat up mechanism including a beat up bar mounting rotatable in synchronism with the shed forming drum, a plurality of beat up bars pivotably mounted on the mounting and having beat up elements extending outwards of the beat up bars, and cam means for controlling the beat up elements to cause them to locate the wefts as the warps pass to the fabric take-up position radially outwards of the shed forming drum and to beat up the wefts and for permitting pivoting of the beat up elements contrary to the direction of rotary movement of the beat up bar mounting so as to move the beat up elements clear of the fabric after beating up.

By pivoting the second beat up elements (which are preferably in the form of thin fingers or reeds) in a contrary direction, the reeds are effectively arrested after their forward beating up motion and can be retracted without excessively disturbing the fell. The cam means positively locate the reeds to enable them to be inserted into the sheds at a predetermined position with accuracy and then to propel the weft between the slower moving warps into the fell before permitting smooth retraction of the reeds. The weft control elements (also called false reeds) may serve to control guide the rapiers or other well insertion means and to advance the weft in the beat up zone until the beat up reeds take over.

The number of beat up bars may vary depending on requirements. A simple common drive arrangement can be used where the number of beat up bars is an integral fraction of the number of shed forming rollers on the drum. The beater bar mounting is then rotated at a ratio with respect to the shed forming drum so that each weft inserted is beaten up by the reeds of a beat up bar. Within these constraints it is preferred that at least four beat up bars are used and that the number of beat up bars is between $\frac{1}{2}$ and $\frac{1}{4}$ of the number of shed forming rollers. At the same time the radius at which the beater bars are pivoted on their mounting is considerably less than the radius of the shed forming roller and the peripheral speed of the beat up reeds is marginally lower than the peripheral speed of the false reeds to that the weft is taken by the beat up bar to the fell, and the beat up reeds move through a considerable angle between entering the sheds and retracting. In this way high speed operation can be achieved together with a positive beating up action without interference between the beat up reeds on the one hand and the false reeds and shed forming rollers on the other hand.

Preferably the weft control elements form a transverse channel for guiding a weft inserting rapier and the drum has rollers with large and small diameter portions. These rollers form the sheds and are rotatable with respect to the shed forming drum and mounted in proximity to the weft control elements. This arrangement together with the predetermined shed forming drum and beat up mounting speed ratio permits the rollers and false reeds to pass the beat up mechanism between the insertion of successive beat up reeds.

Advantageously the beat up bar mounting comprises a generally cylindrical, drum shaped body rotatable by means of a parallel rotatable lay shaft drivingly connected to both ends of the body and the cam means comprise a plurality of axially spaced cams located on a fixed shaft inside the body. This arrangement ensures the simultaneous undistorted movement of the beat up bar mounting and the beat up bars themselves at axially spaced positions. At the same time the cam means are compactly housed, operate in a direct manner and the rotatable mass of the beat up bar mounting can be kept small.

Conveniently the body has abutments for limiting pivotal movements of the beat-up bars and the bars are urged to follow the cam profile by means of springs.

The springs can be used to resist centrifugal forces and yet permit if necessary small departures of the beat up bar from the positions defined by the cam means. The abutments, conveniently of a resilient plastics material, restrain excessive pivotal movements.

Preferably the cam means provide a snail shaped cam track with a general radial part for withdrawal of the second guide elements, and the cam means are angularly adjustable. By setting the cam means at a particular angular position, the position at which the beat up reeds withdraw is clearly predetermined. The fell can be placed in a particular position with respect to the shed forming drum and the timing of the beating up can be altered to occur earlier or later in the opening or closing of a shed. Changes in the angle in which the cam means is set, do not greatly influence the manner in which the weft is picked up by the beat up reeds.

Advantageously the fabric take-up mechanism includes a guide member for holding the fabric clear of the rotatable beat up bar mounting and confine the fell to a predetermined position. The guide member is spaced radially outward with respect to the the shed forming drum and causes the warps to detach from the drum. The guide member thus ensures that the warps move out from between the false reeds in a predetermined manner and position. The beat up reeds can subsequently take over to advance the weft to the fell.

Preferably a means is provided for altering the timing of synchronous rotation of the beat up bar mounting and the shed forming drum. The beat up reeds can thus be made to enter behind the false reeds as these move past the beat up reeds and the timing of the entering movement can be advanced or retarded to achieve the correct weft takeover action.

The overall operation using the above features provides a reliable beat up which can be used to provide both loose and tight weaves at different picking frequencies. The shed forming drum and beat up mechanism function jointly to transfer weft control from the drum to the beat up mechanism without undue interference in a compact mechanism.

The beat up arrangement gives an efficient beat up action even though the beat up occurs on wefts which travel forward at a considerable speed to a beat up zone inside a more slowly moving warp.

DRAWINGS

SPECIFIC DESCRIPTION

Figure 1:
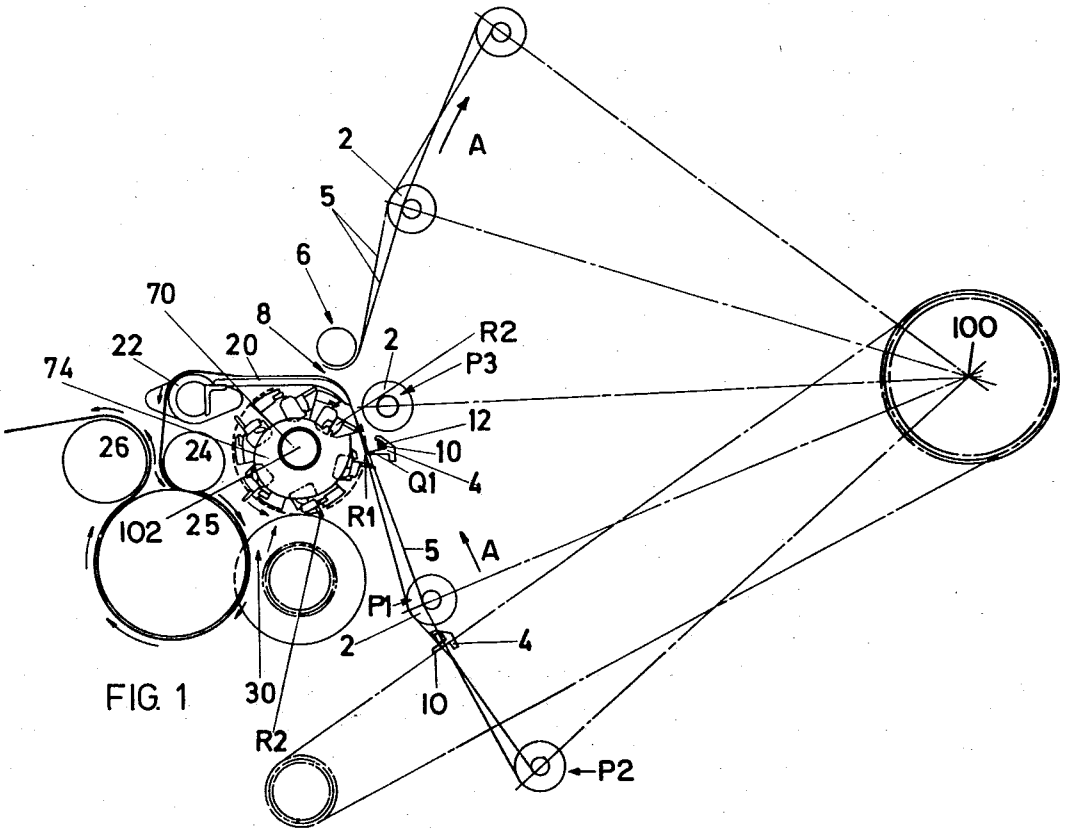
FIG. 1 shows a part side view of a weaving loom of the invention.

A weaving loom of the type described in the U.S. Pat. No. 4,129,153 has a shed forming drum (not shown in detail) with eighteen rollers 2 for guiding warps around the drum and eighteen assemblies of weft control elements or false reeds 4 (see FIG. 1). The details of the rollers 2 can be ascertained from above-mentioned U.S. Pat. No. 4,129,153. In general, each roller 2 consists of discs on a rotatable shaft mounted between side members of the drums to form small and large diameter parts for rolling along the threads forming the warp referred to herein as "warps" 5 as the drum is rotated about a first axis 100. The warps are advanced relatively slowly compared with the peripheral speed of the drum. The sheds formed by the rollers 2 advance from a warp take on position indicated at 6 in FIG. 1 in the direction of arrows A (FIG. 1) to a fabric take-up position indicated at 8. During the advance of the sheds from position 6 to position 8 rapiers 10 move into the sheds, insert a weft and then retract. The rapiers 10 move through channels 12 formed by the false reed assemblies which lie close to rear and front legs of false reeds of respective rollers 2, the false reed assemblies also being mounted between the side members of the drum. The false reeds 4 have an elevated rear weft guiding leg 7 which projects normally between the warps 5. The operation of the shed forming drum and rapiers is described in detail in the U.S. Pat. No. 4,129,153.

The weaving loom has a fabric take-up mechanism (see FIG. 1) for removing woven fabric, which mechanism includes a generally radially arranged fabric guide member or plate 20 having a curved front edge, a guide roller 22, a roller 24 urged resiliently against a larger diameter driven take-up roller 25 and a means for forming the fabric into a roll including a guide roller 26. The take-up roller 25 is driven in conjunction with the warp beam (not shown) supplying the warps to the warp take-on position 6 to advance the warps 5.

A beat up mechanism generally indicated at 30 (see FIG. 2) is mounted under the guide plate 20 and between the take-up roller 25 and the shed forming drum. The beat up mechanism 30 includes a rotatable beat up cage which pivotally supports a number of beat up bars, the beat up mechanism being rotatable about a second axis 102. The cage consists of a plurality of annular members 34 having projecting parts or lobes 36 with recesses 38 therebetween. Axially extending plates 40 are secured to the projecting parts 36 to interconnect the members 34 rigidly. Axially extending abutments strips 42 are secured between the plates 40 and the projecting parts 36. The projections 36 have openings 44 for pivotably supporting six beat up bars indicated generally at 46. The cage has spur gears 48 at each end. The annular members 34 also have recesses 47 for beat up bar abutments 49 which project into the recesses 38.

Figure 4:
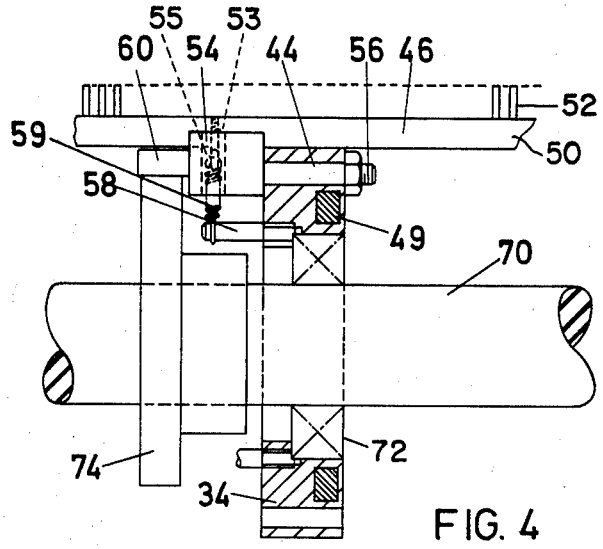
FIG. 4 shows a section along IV—IV in FIG. 3.
Figure 3:
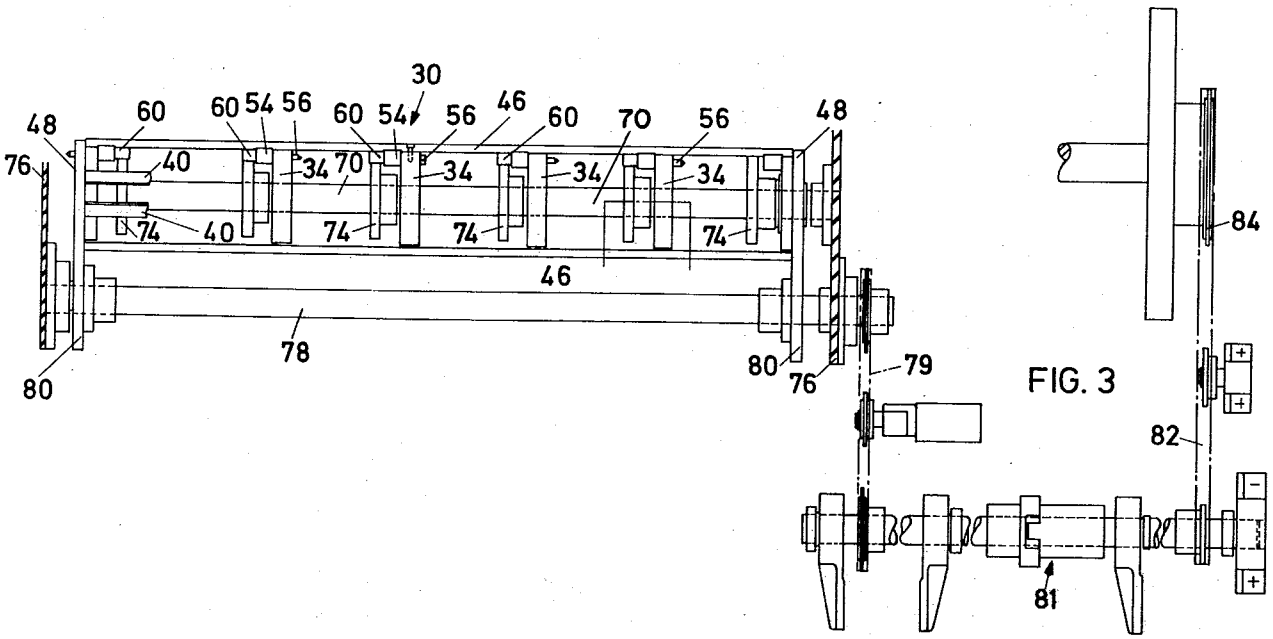
FIG. 3 shows a top view, with some components removed for clarity of the beat up mechanism of FIG. 1 and drive components.
Figure 5:
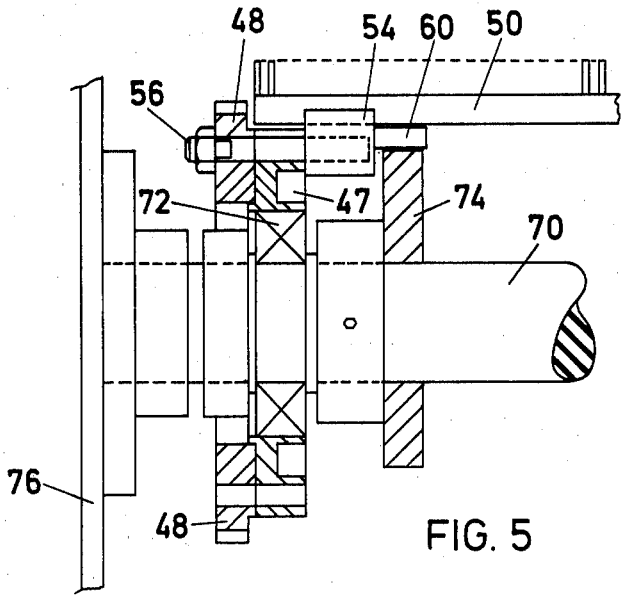
FIG. 5 shows a section along V—V in FIG. 3.

Each beat up bar 46 of the beat up mechanism 30 includes (see FIGS. 3,4,5) a base plate 50 carrying beat up elements or reeds 52 cut at accurately pitched positions coinciding with the positions of the individual false reeds 4. The reeds 52, which are very narrow, have been omitted from FIG. 3 in the interest of clarity. The base plate 50 has arms 54 which are pivotably connected by pins 56 to the openings 44 in the annual members 34. The arms 54 have recesses 53 with hooks 55. The plates 40 have pins 58 projecting sideways. The hooks 55 and pins 58 are interconnected by tensions springs 59 (see FIG. 4) which urge the beat up bars 46 to a retracted attitude in which they lie in the recesses 38. In addition the arms 54 mount a cam follwer 60.

Figure 2:
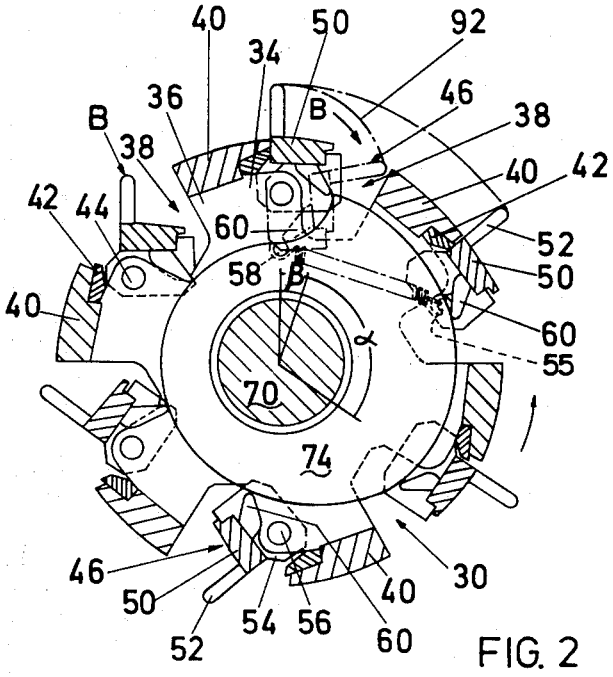
FIG. 2 shows an enlarged side view in section of a beat up mechanism of the loom of FIG. 1.

The overall arrangement is such that the reeds 52 of each beat up bar can be pivoted between (A) a projecting attitude with the leading edge of the base plate 50 resting against the strip 42 and (B) the retracted attitude in which the reeds 52 lie within the circular path travelled by the members 40 and the arms 54 rest against the abutments 42 under the bias of the tension springs as shown in dotted lines in FIG. 2.

The assembly of the cage and the beat up bars 46 is mounted around a centrally arranged, nonrotatable shaft 70 which passes through the spur gears 48 and the members 40 and locates the cage by means of bearings 72. The shaft 70 is concentric with the second axis 102 and supports a plurality of nonrotatable cams 74 which are arranged in proximity to the members 40 and have a cam profile for engaging the cam followers 60. The shaft 70 is secured in an angularly adjustable manner to frame members 76 of the weaving loom.

The assembly is rotated around the shaft 70 by means of a lay-shaft 78 (see FIG. 3) carrying spur gears 80 meshing with the spur gears 48. The lay shaft 78 is rotated through a chain 79, an adjustable coupling 81 and a chain 82 by a sprocket 84 on the shed forming drum. The chain is guided by extra sprocket means shown at 85.

RELATIVE SPEEDS AND TIMING

The operation of the weaving loom is now described with reference to arbitrarily selected operating conditions which can be varied to increase weaving speed, tightness of weave or modify other fabric parameters.

The shed forming drum rotates at 50 r.p.m. so that 900 picks are inserted each minute. The drum radius where the weft is relinquished by the tips of the false reeds is such that the peripheral shed drum speed is 168 cm per sec. The beat up cage rotates at 150 r.p.min giving the requisite 900 beating up actions per minute. The radius of the reeds at the weft pick up position is such that the peripheral speed of the beat up reeds 52 when projected is 152 cm per sec approximately. The warps are taken up at 2.5 cam per sec giving a weave density of 600 picks per meter.

The coupling 81 is now adjusted so that the beat up reeds 52 commence to penetrate between the warp 5 just after the false reeds 4 have passed the row of beat up reeds concerned. The shaft 70 with the cams 74 is set so that the fell is just below the edge of the guide plate 20.

SHEDDING

The shed forming drum will rotate and cause as a result an automatic action for closing the sheds as they are transported to the fabric guide plate 20. In the position of roller 2 indicated at P1 in FIG. 1, a shed is held open by the rollers. As the roller moves from P1 upward, the innermost series of warps 5 comes to extend in a straight line from the fabric guide plate 20 to large diameter parts of the next following roller shown in FIG. 1 at position P2 (assuming a plain weave structure) over the small diameter parts of the roller previously at P1. The shed is now closing as the large diameter parts of the roller previously at P1 moves to a position approximately midway between position P1 and P3 illustrated in FIG. 1. The continued travel of the roller previously at P2 now causes the large diameter parts thereof to push the warps previously innermost to the outermost position. Thus when the roller (previously 16) P2 reaches the position P1 in FIG. 1, the shed will have closed and the next shed will be in a position to repeat the operation.

BEATING UP

Just before the position illustrated in FIG. 1 is reached, a generally concentric portion on the cams 74 holds the beat up reeds 52, which are aprocahing the shed on the drum, fully projected. This portion will continue to hold the beat up reeds projected over angle $\alpha$ (see FIG. 2). The beat up reeds under consideration approach the outermost series of warps 5 and commence to penetrate just after the false reeds 4 have passed whilst extending between the inner and outermost series of warps.

In the position shown in FIG. 1, the shed commences to close and the false reeds at position Q1 have started to move out from the outermost series of warps, permitting the weft at that position to drop behind and to be picked up by the beat up reeds at position R1 which move more slowly behind the false reeds at position Q1.

The beat up reeds at position R1 now advance the weft from position Q1 to the fell as the shed continues to close and beat the weft into the fell when the shed has closed or just after its closing, depending on the adjustment of the cams 74.

The beat up cage continues to rotate but the beat bar under consideration reaches a generally inclined portion of the cams 74 and the beat up reeds pivot backwards having completed the beat up operation. The tip of the reeds originally at position R1 follow the path indicated in chain dotted lines in the direction indicated by arrows B in FIG. 2. The rearwardly curved part of the path 92 is travelled whilst the beat up bar mounting moves through angle $\beta$ occupied by the inclined portion of the cams.

Whilst the reeds under consideration retract and reach the position at R2 in FIG. 1, the next open shed has arrived and the next beat up reed previously at position R1, is coming up to pick up the weft behind the roller which was previously at position P2 but which has since moved on. Thus, as each roller and an adjacent false reed assembly pass the beat up mechanism, one beat up bar 46 is retracting from its projected attitude in front of the roller 2 and another beat up bar 46 is moving into the shed in the projected position behind the false reed assembly. As the reeds complete their retraction, the roller and false reed assembly move on unobstructed at high speed without contacting the slower moving beat up bars whose paths overlap with that of the rollers 2 and false reed assemblies.

The backward pivotal movement of the reeds is limited by the abutments 49 on the different members 40. The low radius parts of the cams 74 next push the cam followers 60 back so as to pivot the beat up bars 46 to their projecting attitude.

In a loose fabric, the beat up reeds 52 "place" or locate the weft in the slow moving fabric and are pivoted backwards by the tension springs sufficiently quickly not to disturb the wefts. In tightly woven fabric, the beater reeds 52 compress the fell temporarily and are pivoted backwards by the return pressure exerted by the fell on the reeds 52 and/or the tension springs.

MODIFIED CONSTRUCTION

Figure 6:
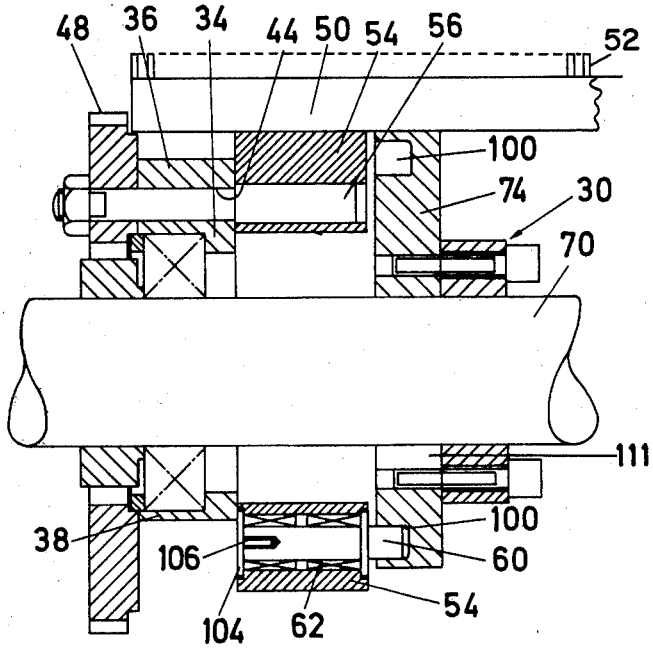
FIG. 6 shows a section similar to FIG. 5 of a modified beat up mechanism.

With reference to FIG. 6, in a modified construction the cam 78 has a groove 100 for exerting positive guidance over the pivotal position of the beat up bars 46. The mounting 54 carries a pin-like cam follower 60 by means of needle bearings 102. The follower 60 is retained by a plate 104 and screw 106. This arrangement no longer requires the use of abutment strips 42; recesses 47; beat up bar abutments 49; pins 58 and associated tension springs. The mode of operation is the same as that described previously. Manufacture is simplified in some respects. Rotating masses can be reduced. Positive beat up bar location permits higher operating speeds.

We claim:

1. In a loom having a shed forming drum rotatable about a first axis, means for guiding warps around the drum to a fabric take-up mechanism, and means for inserting wefts into successive sheds as the drum rotates from a warp take-on position to a fabric take-up position, an improved beat-up mechanism including:

fixed cam means arranged on a second axis parallel to the first axis;

cage means having first annular portions extending around the second axis and second portions extending axially and interconnecting the annular portions, said cage means further have bar means pivotably mounted thereon, said bar means having beat-up elements and means for following said fixed cam means; and means for rotating said cage means about the second axis in synchronism with the drum, said cam means having a generally concentric portion which causes the cam following means of said cage means to extend the beat-up elements of said cage means generally radially and move wefts inserted on the drum to a fell, said cam means also having an inclined portion, the beat-up elements being pivoted radially inwardly with respect to said cage means contrary to the direction of rotary movement of said cage means when said cam following means is in contact with said cam means inclined portion to thereby move the beat-up up elements clear of the fell after beating up whilst said cage means continues to rotate.

2. The loom of claim 1 in which the shed forming drum has rollers for holding warps at radially inward and outward positions located between side members of the drum and weft control elements are mounted between the rollers and the side members, said weft control elements having front and rear legs defining a transverse open channel, and in which the means for inserting wefts are rapiers, the cam means for the controlling the beat-up elements and said cage means being arranged so that the beat-up elements enter the respective sheds behind the weft control elements to move the wefts inserted in the channel to the fell.

3. The loom of claim 2 in which the means for rotating said cage means includes a lay-shaft parallel to the second axis and drivingly connected at both ends to said cage means.

4. The loom of claim 3 in which fixed cam means includes a plurality of axially spaced cams secured to a fixed shaft and in which said cage means annular portions are arranged in proximity to said cams and provide pivotal support for said bar means.

5. The loom of claim 4 in which said cage means has abutments for limiting pivotal movement of said bar means and spring means urge the cam following means onto said cam means.

6. The loom of claim 1 in which the means for rotating said cage means includes a lay-shaft parallel to the second axis and drivingly connected at both ends to said cage means.

7. The loom of claim 1 in which said cam means includes a plurality of axially spaced cams secured to a fixed shaft and in which said cage means annular portions are arranged in proximity to said cams and provide pivotal support for said bar means.

8. The loom of claim 1 in which said cage means has abutments for limiting pivotal movement of said bar means and spring means urge the cam following means onto said cam means.

9. The loom of claim 1 in which said cam means provides a track for controlling pivotal movement of said bar means in the extension and inward directions.

10. The loom of claim 1 in which said cam means is angularly adjustable with respect to the second axis.

11. The loom of claim 1 further comprising means for altering the timing of synchronous rotation of the shed forming drum and said cage means.

12. The loom of claim 1 further comprising a fabric guide member spaced radially outwards of the shed forming drum and extending over the rotatable cage means for holding the fell in a desired position.

* * * * *